US011078553B2

(12) United States Patent
Reinartz et al.

(10) Patent No.: US 11,078,553 B2
(45) Date of Patent: Aug. 3, 2021

(54) METHOD AND DEVICE FOR THE HEAT TREATMENT OF A METAL COMPONENT

(71) Applicant: SCHWARTZ GMBH, Simmerath (DE)

(72) Inventors: Andreas Reinartz, Monschau (DE); Jörg Winkel, Nideggen-Schmidt (DE); Frank Wilden, Simmerath (DE)

(73) Assignee: Schwartz GmbH, Simmerath (DE)

( * ) Notice: Subject to any disclaimer, the term of this patent is extended or adjusted under 35 U.S.C. 154(b) by 277 days.

(21) Appl. No.: 16/072,418

(22) PCT Filed: Jan. 25, 2017

(86) PCT No.: PCT/EP2017/051507
§ 371 (c)(1),
(2) Date: Jul. 24, 2018

(87) PCT Pub. No.: WO2017/129599
PCT Pub. Date: Aug. 3, 2017

(65) Prior Publication Data

US 2019/0032162 A1 Jan. 31, 2019

(30) Foreign Application Priority Data

Jan. 25, 2016 (DE) ..... 10 2016 201 024.7
Jan. 25, 2016 (DE) ..... 10 2016 201 025.5
(Continued)

(51) Int. Cl.
*C21D 9/00* (2006.01)
*C21D 8/02* (2006.01)
(Continued)

(52) U.S. Cl.
CPC ..... *C21D 9/0062* (2013.01); *C21D 1/19* (2013.01); *C21D 1/673* (2013.01); *C21D 6/005* (2013.01);
(Continued)

(58) Field of Classification Search
CPC ..... C21D 9/0062; C21D 1/19; C21D 1/00; C21D 8/0205
See application file for complete search history.

(56) References Cited

U.S. PATENT DOCUMENTS 9,359,663 B2 6/2016 Mizuta et al.
2015/0299817 A1 10/2015 Shimotsu et al.

FOREIGN PATENT DOCUMENTS

DE 10208216 3/2003
DE 102010049205 4/2012
(Continued)

OTHER PUBLICATIONS

EP2548975A1 English translation (Year: 2020).*
(Continued)

*Primary Examiner* — Nicholas A Wang
*Assistant Examiner* — Jiangtian Xu
(74) *Attorney, Agent, or Firm* — Occhiuti & Rohlicek LLP

(57) ABSTRACT

Disclosed are implementations for heat treatment of a metal component, and a use of a furnace for heating a metal component. The implementations can be used in the partial hardening of optionally pre-coated components made of a high-strength manganese-boron steel. An example method for heat treatment of a metal component comprises at least the following steps: a) heating the component in a first furnace; b) moving the component into a temperature control station; c) cooling at least one first sub-region of the component in the temperature control station, wherein a temperature difference is set between the at least one first sub-region and at least one second sub-region of the component; d) moving the component from the temperature control station into a second furnace; and e) heating at least
(Continued)

the at least one first sub-region of the component in the second furnace by at least 200 K.

8 Claims, 2 Drawing Sheets

(30) Foreign Application Priority Data

| | | |
|---|---|---|
| Feb. 9, 2016 | (DE) | 10 2016 201 936.8 |
| Feb. 23, 2016 | (DE) | 10 2016 202 766.2 |
| Sep. 27, 2016 | (DE) | 10 2016 118 252.4 |

(51) Int. Cl.

| | |
|---|---|
| ***C21D 1/19*** | (2006.01) |
| ***C21D 1/673*** | (2006.01) |
| ***C21D 6/00*** | (2006.01) |
| *C21D 1/667* | (2006.01) |

(52) U.S. Cl.
CPC ..... *C21D 8/0205* (2013.01); *C21D 9/0068* (2013.01); *C21D 1/667* (2013.01); *C21D 2221/00* (2013.01)

(56) References Cited

FOREIGN PATENT DOCUMENTS

| | | | | |
|---|---|---|---|---|
| DE | 102013104229 | | 10/2014 | |
| DE | 102013010946 | B3 | 12/2014 | |
| DE | 102014201259 | | 7/2015 | |
| EP | 2548975 | | 1/2013 | |
| EP | 2548975 | A1 * | 1/2013 | ..... C21D 1/20 |
| JP | 2014-156653 | A | 8/2014 | |
| KR | 20120110961 | | 10/2012 | |
| WO | 2010/150683 | A1 | 12/2010 | |

OTHER PUBLICATIONS

EP2548975A1 English translation by machine. (Year: 2020).*

H. Karbasian et al., "A review on hot stamping", Journal of Materials Processing Technology, vol. 210, No. 15, Nov. 1, 2010, pp. 2103-2118.

Japanese Decision of Rejection dated Apr. 6, 2021 in JP Application No. 2018-538751.

Japanese Office Action dated Oct. 21, 2020 in JP Application No. 2018-538751.

* cited by examiner

METHOD AND DEVICE FOR THE HEAT TREATMENT OF A METAL COMPONENT

CROSS REFERENCE TO RELATED APPLICATIONS

This application is a National Phase under 35 U.S.C. 371 of International Application No. PCT/EP2017/051507 filed on Jan. 25, 2017, which claims priority to German Application No. 10 2016 201 024.7 filed Jan. 25, 2016, German Application No. 10 2016 201 025.5 filed Jan. 25, 2016, German Application No. 10 2016 201 936.8 filed Feb. 9, 2016, German Application No. 10 2016 202 766.2 filed Feb. 23, 2016 and German Application No. 10 2016 118 252.4 filed Sep. 27, 2016 the contents of which are hereby incorporated by reference in their entirety.

The invention relates to a method and to a device for heat treating a metal component, and to a use of a furnace for heating a metal component. The invention is used, in particular, during the partial hardening of optionally pre-coated components made of a high-strength manganese-boron steel.

To produce safety-relevant vehicle body parts made of sheet steel, it is generally required to harden the sheet steel while or after it is formed into the body part. For this purpose, a heat treatment method referred to as "press hardening" has established itself. In this process, the sheet steel, which is generally provided in the form of a blank, is initially heated in a furnace and thereafter is cooled during the forming operation in a press, whereby it is hardened.

There has been an endeavor for several years now to use press hardening to provide body parts of motor vehicles, such as A and B pillars, side impact protection beams in doors, sills, frame parts, bumpers, transverse beams for the floor and roof, and front and rear longitudinal beams, which have differing strengths in sub-regions, so that the body part can partially fulfill different functions. For example, the center region of a B pillar of a vehicle should have high strength so as to protect the occupants in the event of a side impact. At the same time, the upper and lower end regions of the B pillar should have comparatively low strength, so as to be able to absorb deformation energy during a side impact, while enabling easy connectability to other body parts during the installation of the B pillar.

So as to create such a partially hardened body part, it is necessary for the hardened component to have differing material microstructures or strength properties in the sub-regions. So as to set differing material microstructures or strength properties after hardening, the sheet steel to be hardened may, for example, already be provided with differing sheet sections that are joined to one another or may be partially cooled differently in the press.

As an alternative or in addition, there is the option to subject the sheet steel to be hardened to partially differing heat treatment processes prior to the cooling and forming steps in the press. In this connection, for example, it possible to heat only sub-regions of the sheet steel to be hardened in which a transformation toward harder microstructures, such as martensite, is to be effectuated. This kind of process control, however, generally has the disadvantage that the inward diffusion of a coating, which is usually to be applied to the surface of the sheet steel to protect against scaling, such as an aluminum silicon coating, cannot be efficiently integrated into the heat treatment process. Furthermore, the option exists to carry out the partial heat treatment by way of contact plates, which are designed to partially control the temperature of the sheet steel by way of heat conduction. This, however, requires a certain contact time with the plates, which is usually longer than a (minimum) cycle time achievable by the downstream press. Furthermore, the coordination between a certain contact time and the cycle time at the press generally makes it more difficult to integrate corresponding temperature control stations into a press hardening line on an industrial scale, where production fluctuations during operation are in general unavoidable.

Proceeding from this, it is the object of the present invention to at least partially solve the problems described with regard to the prior art. In particular, a method and a device for heat treating a metal component and a use of a furnace for heating a metal component are to be provided, which, in particular, allow a partially differing heat treatment of the component to be carried out as efficiently as possible on an industrial scale. Moreover, the method, the device and the use are to help reduce the influence of the process segment of the heat treatment process located upstream of the press on the cycle time of the overall heat treatment process.

These objects are achieved by the features of the independent claims. Further advantageous embodiments of the solution disclosed herein are described in the dependent claims. It should be noted that the features listed individually in the dependent claims can be combined with one another in any arbitrary, technologically meaningful manner and define further embodiments of the invention. Furthermore, the features described in the claims are specified and explained in greater detail in the description, wherein further preferred embodiments of the invention are presented.

A method according to the invention for the (partially differing) heat treatment of a metal component comprises at least the following steps:

a) heating the component in a first furnace;
b) moving the component into a temperature control station;
c) (partially and/or convectively) cooling at least one first sub-region of the component in the temperature control station, wherein a temperature difference is set between the at least one first sub-region and at least one second sub-region of the component;
d) moving the component from the temperature control station into a second furnace; and
e) heating at least the at least one first sub-region of the component in the second furnace by at least 200 K [Kelvin].

The indicated sequence of method steps a), b), c), d) and e) is derived with a regular process of the method. Individual or multiple of the method steps may be carried out simultaneously, consecutively and/or at least partially simultaneously. The method is preferably carried out using a device disclosed herein.

The disclosed method is used, in particular, for the targeted component zone-specific heat treatment of a (steel) component or for setting different microstructures in a targeted manner in various sub-regions of a steel component. Preferably, the method is used to partially harden optionally pre-coated components made of a (high-strength) manganese-boron steel.

In a particularly advantageous manner, the disclosed method makes it possible to reliably carry out a partially differing heat treatment of a component even on an industrial scale. In particular due to the fact that the cooling in the temperature control station is followed by another heating process or a renewed supply of thermal energy, the influence of the process segment of the heat treatment process located upstream of the press on the cycle time of the overall heat treatment process can be reduced.

Preferably, the component remains in the temperature control station for less than fifteen seconds, in particular less than ten second or even less than five seconds.

Thereafter, the component may be kept available in a batch furnace, or transported through a continuous furnace, together with other components treated in the temperature control station before or thereafter. In a particularly advantageous manner, this makes it possible to match the cycle time of the heat treatment process, which is located upstream of the press, to the cycle time of the press. Moreover, the invention, in particular, turns away from process controls in which a cooled or intermediately cooled region of a component is kept isothermally over a certain time period so as to transform previously formed austenite into microstructures such as bainite, ferrite and/or pearlite. Rather, surprisingly, it was found within the scope of the invention that renewed heating, as compared to keeping the component isothermally, can result in improved, and in particular higher, tensile strengths in the more ductile regions of the hardened component.

The metal component is preferably a metal blank, a sheet steel or an at least partially preformed semi-finished product. The metal component is preferably made with or of a (hardenable) steel, for example a boron (manganese) steel, such as that with the designation 22MnB5. It is furthermore preferred that the metal component is provided or pre-coated with a (metal) coating at least to a large degree. For example, the metal coating may be a coating (predominantly) comprising zinc, or a coating (predominantly) comprising aluminum and/or silicon, and in particular what is known as an aluminum/silicon (Al/Si) coating.

In step a), the (entire) component is heated in a first furnace. Preferably, the component is heated homogeneously or uniformly in the first furnace. It is furthermore preferred that the component is heated in the first furnace (exclusively) by way of radiant heat, for example by at least one electrically operated heating element (not making physical or electrical contact with the component), such as a heating loop and/or a heating wire, and/or by at least one (gas-heated) radiant tube.

In step b), the component is moved, in particular, from the first furnace into a temperature control station. For this purpose, a transport unit may be provided, for example at least comprising a roller table and/or an (industrial) robot. Preferably, the component travels a distance of at least 0.5 m [meters] from the first furnace to the temperature control station. The component may be guided in contact with the ambient area or within a protective atmosphere.

In step c), at least one first sub-region of the component is (actively) cooled in the temperature control station. For this purpose, a temperature difference is set between the at least one first sub-region (which is more ductile in the fully treated component) and at least one second sub-region (which is harder in the fully treated component) of the component. After cooling, the component has partially differing (component) temperatures, wherein a temperature difference is set between a first temperature of the at least one first sub-region and a second temperature of the at least one second sub-region of the component. Moreover, it is possible to set several (different) temperature differences between sub-regions of the component in step c). It is possible, for example, to set three or more sub-regions in the component, each having a temperature different from the others.

The cooling in step c) preferably takes place by way of convection, and particularly preferably by means of at least one nozzle discharging a fluid. For this purpose, the nozzle may be disposed in the temperature control station and oriented toward the first sub-region. The fluid may be air, nitrogen, water or a mixture thereof, for example. The cooling preferably takes place by means of a nozzle array comprising multiple nozzles, each discharging a fluid, wherein particularly preferably the shape of the nozzle array and/or the arrangement of the multiple nozzles is adapted to the (desired) geometry of the at least one first sub-region of the component.

The cooling preferably takes place by means of a plurality of nozzles, and in particular by means of at least five or even at least ten nozzles, which can be activated individually or in groups and which, in particular, can be supplied with a (certain) fluid volume flow. The nozzles are preferably activated as a function of time. It is furthermore preferred that the nozzles are activated (individually or in groups) in such a way that one or more temperature differences are set deliberately between sub-regions of the component, for example between the at least one first sub-region and the at least one second sub-region. Moreover, the nozzles can be activated (individually or in groups) in such a way that ambient influencing conditions in the temperature control station, which can act on the component upon leaving the temperature control station, can be compensated for. Such a compensation, which in particular shall be understood to mean a prevention, may take place in such a way, for example, that a region of the component located closer to the edge, and in particular a region of the at least one first sub-region located closer to the component edge, is cooled to a lesser degree than a region of the component located further away from the edge, and in particular than a region of the at least one first sub-region of the component located further away from the component edge, so as to take into consideration or even (substantially) compensate for faster cooling of the component in the edge regions thereof, which may possibly take place upon leaving the temperature control station, in particular in the heat exchange with the surrounding area.

It is furthermore preferred that an input of thermal energy into the at least one second sub-region of the component takes place in the temperature control station, simultaneously or at least partially simultaneously with the cooling of the at least one first sub-region of the component. Preferably, the at least one second sub-region of the component is subjected in the temperature control station (exclusively) to heat radiation, which is generated and/or irradiated, for example, by at least one electrically operated or heated heating element, which is disposed in particular in the temperature control station (and does not make contact with the component), such as a heating loop and/or a heating wire, and/or by at least one (gas-heated) radiant tube, which is, in particular, disposed in the temperature control station.

The input of thermal energy into the at least one second sub-region of the component can preferably take place in the temperature control station in such a way that a decrease in the temperature of the at least one second sub-region and/or a cooling rate of the at least one second sub-region is at least reduced while the component remains in the temperature control station. This process control is in particular advantageous when the component was heated in step a) to a temperature above the Ac3 temperature. As an alternative, the input of thermal energy into the at least one second sub-region of the component in the temperature control station may take place in such a way that the at least one second sub-region of the component is heated (considerably), in particular by at least approximately 50 K. This process control is in particular advantageous when the component was heated in step a) to a temperature below the Ac3 temperature, or even below the Ac1 temperature.

In step d), the component is moved from the temperature control station into a second furnace. For this purpose, a transport unit may be provided, for example at least comprising a roller table and/or an (industrial) robot. The component preferably travels a distance of at least 0.5 m from the temperature control station to the second furnace.

The component may be guided in contact with the ambient area or within a protective atmosphere. Preferably, the component is transferred directly into the second furnace immediately upon having been removed from the temperature control station.

In step e), at least the at least one first sub-region of the component is heated in the second furnace by at least 200 K. In other words, another heating process takes place in the second furnace, wherein at least the previously (actively) cooled at least one first sub-region is heated by at least 200 K. Preferably, at least the at least one first sub-region of the component is heated in the second furnace (exclusively) by way of radiant heat, for example by at least one electrically operated heating element (not making contact with the component), such as a heating loop and/or a heating wire, and/or by at least one (gas-heated) radiant tube. It is furthermore preferred that in step e), in particular simultaneously or at least partially simultaneously with the heating of the at least one first sub-region, the at least one second sub-region of the component is heated in the second furnace by at least 50 K, particularly preferably by at least 70 K or even by at least 100 K, in particular (exclusively) by way of radiant heat. Particularly preferably, the at least one second sub-region of the component is heated in step e) to a temperature above the Ac1 temperature or even above the Ac3 temperature.

Alternatively, in step e), in particular simultaneously or at least partially simultaneously with the heating of the at least one first sub-region, a decrease in the temperature of the at least one second sub-region and/or a cooling rate of the at least one second sub-region is at least reduced while the component remains in the second furnace.

In other words, in step e) an input of thermal energy, in particular by way of radiant heat, into the entire component may take place. For example, the second furnace may (for this purpose) include a furnace interior, which in particular is heated (exclusively) by way of radiant heat, in which preferably a substantially uniform inside temperature prevails. The input of thermal energy into the at least one first sub-region of the component in the second furnace preferably takes place in such a way that the temperature of the at least one first sub-region is increased by at least 100 K, preferably by at least 120 K, particularly preferably by at least 150 K or even by at least 200 K.

The input of thermal energy into the at least one second sub-region of the component in the second furnace can preferably take place in such a way that a decrease in the temperature of the at least one second sub-region and/or a cooling rate of the at least one second sub-region is at least reduced while the component remains in the second furnace. This process control is in particular advantageous when the component was heated in step a) to a temperature above the Ac3 temperature. As an alternative, the input of thermal energy into the at least one second sub-region of the component in the second furnace can take place in such a way that the at least one second sub-region of the component is at least (considerably) heated, in particular by at least 50 K, particularly preferably by at least 70 K or even by at least 100 K, and/or is heated to a temperature above the Ac1 temperature or even above the Ac3 temperature. This process control is in particular advantageous when the component was heated in step a) to a temperature below the Ac3 temperature, or even below the Ac1 temperature.

According to an advantageous embodiment, it is proposed that the method furthermore comprises at least the following steps:

f) moving the component from the second furnace into a press hardening tool; and g) forming and cooling the component in the press hardening tool.

Preferably, the moving in step f) takes place by means of a transport device, for example at least comprising a roller table and/or an (industrial) robot. Preferably, the component travels a distance of at least 0.5 m from the second furnace to the press hardening tool. The component may be guided in contact with the ambient area or within a protective atmosphere. Preferably, the component is transferred directly into the press hardening tool immediately upon having been removed from the second furnace.

According to an advantageous embodiment, it is proposed that the component is heated in step a) to a temperature below the Ac3 temperature, or even below the Ac1 temperature. The Ac1 temperature is the temperature at which the transformation from ferrite to austenite begins when a metal component, and in particular a steel component, is heated.

According to an (alternative) advantageous embodiment, it is proposed that the component is heated in step a) to a temperature above the Ac3 temperature. The Ac3 temperature is the temperature at which the transformation from ferrite to austenite ends or has been (entirely) completed when a metal component, and in particular a steel component, is heated.

According to an advantageous embodiment, it is proposed that the at least one first sub-region is cooled in step c) by way of convection to a temperature below the Ac1 temperature. Preferably, the at least one first sub-region is cooled in step c), in particular by way of convection, to a temperature below 550° C. [degrees Celsius](823.15 K), particularly preferably below 500° C. (773.15 K) or even below 450° C. (723.15 K).

According to a further aspect, a method for heat treating a metal component comprising at least the following steps is disclosed:

a) heating the component by way of radiant heat and/or convection, in particular in a first furnace, by at least 500 K, preferably by at least 600 K or even by at least 800 K;

b) (partially and/or convectively) cooling at least one first sub-region of the component, in particular in a temperature control station located downstream of the first furnace, wherein a temperature difference of at least 100 K, preferably of at least 150 K or even of at least 200 K is set between the at least one first sub-region and at least one second sub-region of the component;

c) heating at least the at least one first sub-region of the component by way of radiant heat and/or convection, in particular in a second furnace located downstream of the temperature control station, by at least 100 K, preferably by at least 150 K or even by at least 200 K.

The indicated sequence of method steps a), b) and c) is derived during a regular process of the method. Individual or multiple of the method steps may be carried out simultaneously, consecutively and/or at least partially simultaneously. The method is preferably carried out using a device disclosed herein.

Preferably, the at least one first sub-region of the component is heated in step c) or in the second furnace by no more than 350 K, particularly preferably by no more than 300 K or even by no more than 250 K. The heating in step c) or in the second furnace preferably takes place in such a way that only the at least one first sub-region of the component is heated by at least 100 K, preferably by at least 150 K or even by at least 200 K. Particularly preferably, the at least one second sub-region of the component is heated in step c) or in the second furnace by less than 200 K, preferably by less than 150 K or even by less than 100 K.

According to an advantageous embodiment, it is proposed that the component is simultaneously formed and cooled in step d). Preferably, the component is press hardened in step d).

The details, features and advantageous embodiments described in connection with the method disclosed first may also be present accordingly with the method disclosed here, and vice versa. In this regard, all the comments provided there to further characterize the features are hereby incorporated by reference.

According to a further aspect, a device for heat treating a metal component is disclosed, comprising at least the following:

- a first furnace heatable in particular by way of radiant heat and/or convection;
- a temperature control station located downstream of the first furnace, in which at least one nozzle is disposed or held, which is provided to discharge a fluid for cooling at least one first sub-region of the component and configured such that a temperature difference can be set between the at least one first sub-region and at least one second sub-region of the component;
- a second furnace located downstream of the temperature control station and heatable, in particular, by way of radiant heat and/or convection, which is provided and configured for heating at least the at least one first sub-region of the component by at least 100 K, preferably by at least 150 K or even by at least 200 K.

The device is preferably used to carry out the method disclosed herein. Preferably, an electronic control unit, which is suitable for carrying out a method disclosed herein and configured therefor, is assigned to the device. Particularly preferably, the control unit comprises at least one program-controlled microprocessor and an electronic memory for this purpose, a control program that is provided and configured for carrying out a method disclosed herein being stored in the memory.

According to a further advantageous embodiment, it is proposed that at least the first furnace or the second furnace is a continuous furnace or a batch furnace. Preferably, the first furnace is a continuous furnace, and in particular a roller hearth furnace. The second furnace is particularly preferably a continuous furnace, and in particular a roller hearth furnace, or a batch furnace, and in particular a multi-level batch furnace comprising at least two chambers disposed on top of one another.

The second furnace preferably includes a furnace interior, which in particular is heatable (exclusively) by way of radiant heat, in which preferably a substantially uniform inside temperature can be set. In particular when the second furnace is designed as a multi-level batch furnace, multiple such furnace interiors may be present corresponding to the number of chambers.

Preferably, (exclusively) radiant heat sources are disposed in the first furnace and/or in the second furnace. It is particularly preferred when at least one electrically operated heating element (not making contact with the component), such as at least one electrically operated heating loop and/or at least one electrically operated heating wire, is disposed in a furnace interior of the first furnace and/or in a furnace interior of the second furnace. As an alternative or in addition, at least one, in particular gas-heated, radiant tube may be disposed in the furnace interior of the first furnace and/or the furnace interior of the second furnace. Preferably, multiple radiant tube gas burners or radiant tubes into each of which at least one gas burner burns are disposed in the furnace interior of the first furnace and/or the furnace interior of the second furnace. It is particularly advantageous when the inner region of the radiant tubes into which the gas burners burn is atmospherically separated from the furnace interior, so that no combustion gases or exhaust gases can reach the furnace interior, and thus influence the furnace atmosphere. Such a system is also referred to as "indirect gas heating."

At least one nozzle, which is provided and configured for discharging a fluid, is disposed or held in the temperature control station. Particularly preferably, the at least one nozzle is oriented so as to be able to discharge the fluid toward the first sub-region of the component. It is furthermore preferred that a nozzle array comprising multiple nozzles is disposed in the temperature control station, wherein each of the nozzles is provided and configured for discharging a fluid. Particularly preferably, a shape of the nozzle array and/or an arrangement of the multiple nozzles is adapted to the (desired) geometry of the at least one first sub-region of the component.

Preferably, at least one heating unit is disposed in the temperature control station. The heating unit is preferably provided and configured for inputting thermal energy into the at least one second sub-region of the component. Particularly preferably, the heating unit is disposed and/or oriented in the temperature control station in such a way that the input of thermal energy into the at least one second sub-region of the component can be carried out simultaneously, or at least partially simultaneously, with the cooling of the at least one first sub-region of the component by means of the at least one nozzle. Preferably, the heating unit (exclusively) comprises at least one radiant heat source. Particularly preferably, the at least one radiant heat source is designed with at least one electrically operated heating element (not making contact with the component), such as at least one electrically operated heating loop and/or at least one electrically operated heating wire. As an alternative or in addition, at least one gas-heated radiant tube can be provided as the radiant heat source.

Furthermore, the device can comprise a press hardening tool, which is located downstream of the second furnace. The press hardening tool is, in particular, provided and configured for simultaneously, or at least partially simultaneously, forming and (at least partially) quenching the component.

The details, features and advantageous embodiments described in connection with the methods may also be present accordingly with the device disclosed herein, and vice versa. In this regard, all the comments provided there to further characterize the features are hereby incorporated by reference.

According to a further aspect, a use of a furnace for heating at least sub-regions of a metal component by way of radiant heat by at least 100 K, preferably by at least 150 K or even by at least 200 K is disclosed, wherein the component to be thus heated already comprises at least two sub-regions that have been controlled to differing temperatures. The furnace is preferably a second furnace, which is located downstream of the first furnace and a temperature control station. It is furthermore preferred that the sub-regions to be heated by way of the furnace are previously (actively), and in particular convectively, cooled sub-regions of the component.

The details, features and advantageous embodiments described above in connection with the methods and/or the device may also be present accordingly with the use disclosed herein, and vice versa. In this regard, all the comments provided there to further characterize the features are hereby incorporated by reference.

The invention and the technical environment will be described in more detail hereafter based on the figures. It should be noted that the invention shall not be limited by the shown exemplary embodiments. In particular, it is also possible, unless explicitly described otherwise, to extract partial aspects of the subject matter described in the figures, and to combine these with other components and/or findings from other figures and/or the present description. In the schematic drawings.

Figure 1:
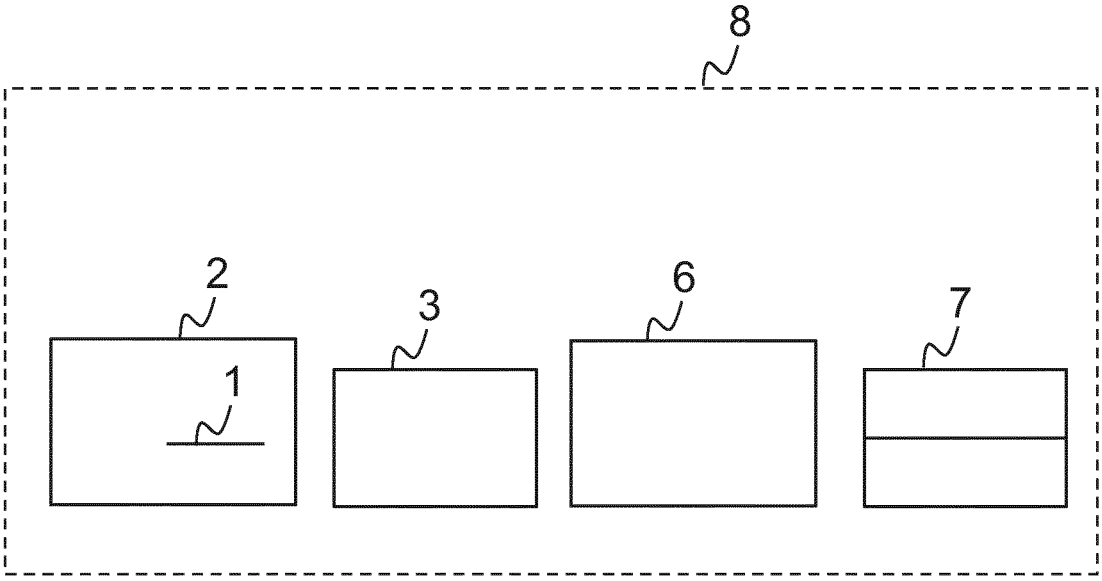
FIG. 1 shows a diagram of a device according to the invention.

FIG. 1 schematically shows a device 8 according to the invention for heat treating a metal component 1, comprising a first furnace 2, a temperature control station 3, a second furnace 6, and a press hardening tool 7. The device 8 represents a hot forming line for press hardening here. The temperature control station 3 is located (directly) downstream of the first furnace 6, so that a component 1 to be treated by means of the device 8 can be transferred directly into the temperature control station 3 upon leaving the first furnace 6. Furthermore, the second furnace 6 of the temperature control station 3 and the press hardening tool 7 are located (directly) downstream of the second furnace 6.

Figure 2:
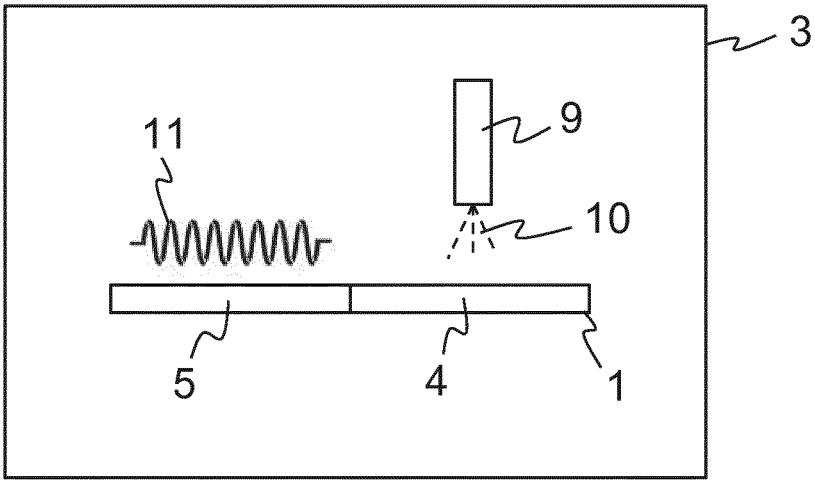
FIG. 2 shows a detailed view of a temperature control station usable in a device according to the invention.

FIG. 2 schematically shows a detailed view of a temperature control station 3, which can be used in a device 8 according to the invention, such as is shown in FIG. 1, for example. A nozzle 9, which is provided and configured for discharging a fluid 10 for cooling a first sub-region 4 of a component 1, is disposed in the temperature control station 3. Moreover, a heating unit 11, which is provided and configured for inputting thermal energy into a second sub-region 5 of the component 1, is disposed in the temperature control station 3. For this purpose, the heating unit 11 is designed as an electrically operated heating wire, for example.

Figure 3:
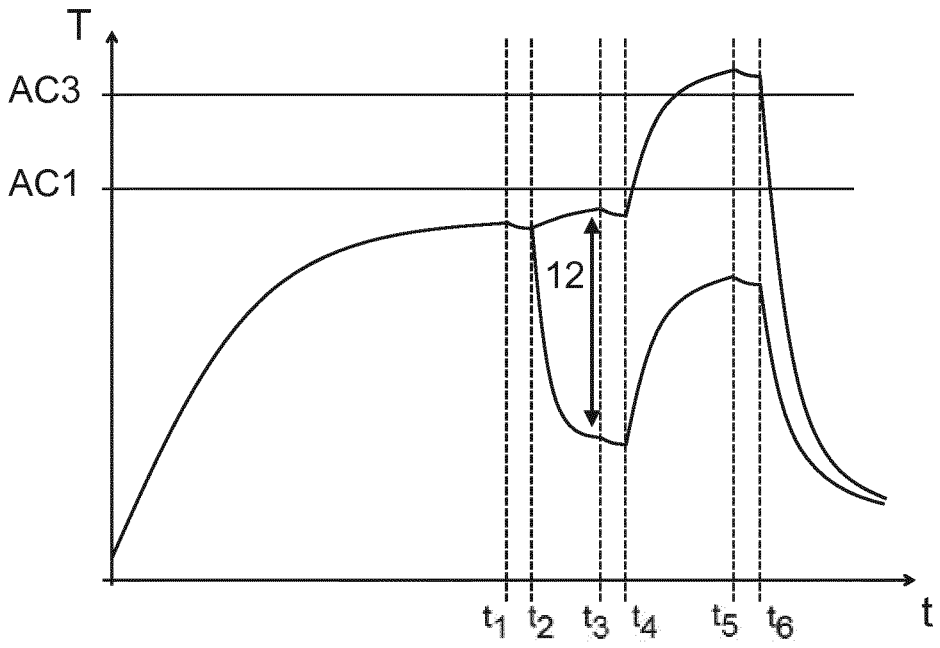
FIG. 3 shows a time-temperature curve achievable by means of a device according to the invention and/or a method according to the invention.

FIG. 3 schematically shows a time-temperature curve achievable by means of a device 8 according to the invention and/or a method according to the invention. The temperature T of the metal component is, or the temperatures T of the at least one first sub-region and of the at least one second sub-region of the component are, plotted against the time t.

According to the time-temperature curve shown in FIG. 3, the metal component 1 is first uniformly heated to a temperature below the Ac1 temperature up until the point in time $t_1$. By way of example, this heating takes place in a first furnace 2 here. Between the points in time $t_1$ and $t_2$, the metal component is transferred from the first furnace into a temperature control station. The component temperature may decrease slightly during this process, for example due to heat emission to the surrounding area.

Between the points in time $t_2$ and $t_3$, at least one first sub-region of the component is (actively) cooled in the temperature control station. This is illustrated in FIG. 3 based on the bottom time-temperature curve between the points in time $t_2$ and $t_3$. At the same time, at least one second sub-region of the component is (slightly) heated in the temperature control station. This is illustrated in FIG. 3 based on the top time-temperature curve between the points in time $t_2$ and $t_3$. In this way, a temperature difference 12 is set in the temperature control station between the at least one first sub-region and at least one second sub-region of the component.

Between the points in time $t_3$ and $t_4$, the component is transferred from the temperature control station into a second furnace different from the first furnace. The partially differing temperatures set in the temperature control station may decrease slightly during this process, for example due to heat emission to the surrounding area.

The component is heated in the second furnace from the point in time $t_4$ to the point in time $t_5$ in such a way that the temperature of the at least one first sub-region of the component is increased by at least 150 K. Furthermore, the heating in the second furnace takes place in such a way that, at the same time, the temperature of the at least one second sub-region of the component is brought to a temperature above the Ac3 temperature.

Between the points in time $t_5$ and $t_6$, the component is transferred from the second furnace into a press hardening tool. The partially differing temperatures set in the second furnace may decrease slightly during this process, for example due to heat emission to the surrounding area.

From the point in time $t_6$ until the end of the process, the (entire) component is quenched in the press hardening tool. It is possible for a martensitic microstructure to be produced at least partially or even predominantly in the at least one second sub-region of the component, which has comparatively high strength and comparatively low ductility. Essentially no transformation has taken place in the at least one first sub-region of the component since the at least one first sub-region of the component has not exceeded the Ac1 temperature at any point during the process, so that a predominantly ferritic microstructure remains in the at least one first sub-region of the component, which has comparatively low strength and comparatively high ductility.

Figure 4:
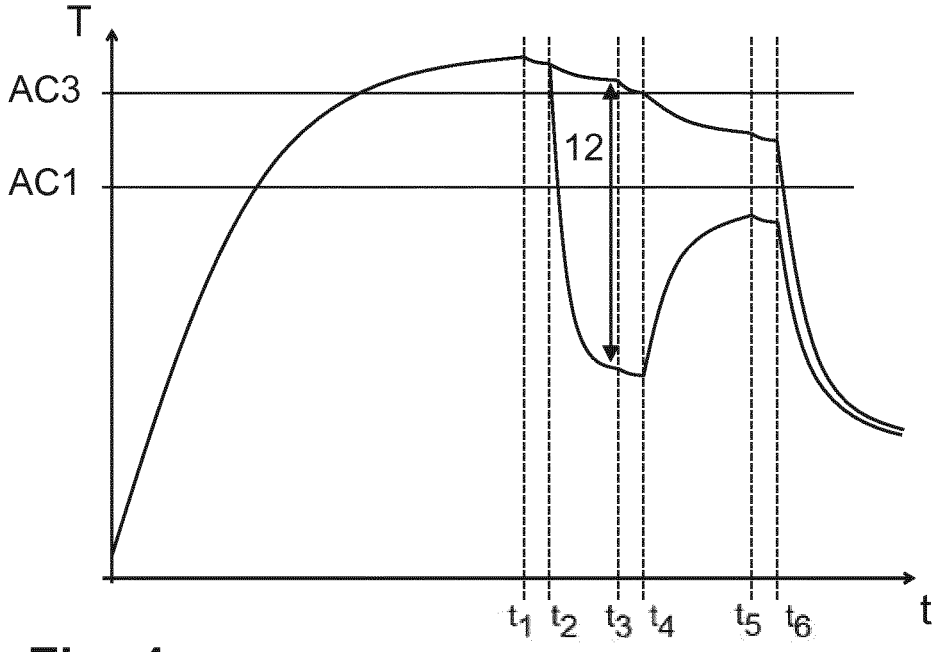
FIG. 4 shows a time-temperature curve achievable by means of a further device according to the invention and/or a method according to the invention.

FIG. 4 schematically shows a further time-temperature curve achievable by means of a device according to the invention and/or a method according to the invention. Initially, the metal component is uniformly heated to a temperature above the Ac3 temperature up until the point in time $t_1$.

By way of example, this heating takes place in a first furnace here. Between the points in time $t_1$ and $t_2$, the metal component is transferred from the first furnace into a temperature control station. The component temperature may decrease slightly during this process.

Between the points in time $t_2$ and $t_3$, at least one first sub-region of the component is (actively) cooled in the temperature control station. This is illustrated in FIG. 4 based on the bottom time-temperature curve between the points in time $t_2$ and $t_3$. At the same time, the temperature of at least one second sub-region of the component may decrease slightly in the temperature control station. This is illustrated in FIG. 4 based on the top time-temperature curve between the points in time $t_2$ and $t_3$. This (passive) decrease in temperature in the at least one second sub-region of the component has a considerably lesser cooling rate than the simultaneous (active) cooling of the at least one first sub-region of the component. It is apparent from FIG. 4 that a temperature difference 12 is set between the at least one first sub-region and at least one second sub-region of the component in the temperature control station.

Between the points in time $t_3$ and $t_4$, the component is transferred from the temperature control station into a second furnace different from the first furnace. The partially differing temperatures set in the temperature control station may decrease slightly during this process.

The component is heated in the second furnace from the point in time $t_4$ to the point in time $t_5$ in such a way that the temperature of the at least one first sub-region of the component is increased by at least 150 K. Moreover, the heating in the second furnace takes place in such a way that, at the same time, a cooling rate of the at least one second sub-region of the component is reduced compared to a cooling rate during heat emission to the surrounding area.

Between the points in time $t_5$ and $t_6$, the component is transferred from the second furnace into a press hardening tool. The partially differing temperatures set in the second furnace may decrease slightly during this process, for example due to heat emission to the surrounding area.

From the point in time $t_6$ until the end of the process, the (entire) component is quenched in the press hardening tool. It is possible for a martensitic microstructure to be produced at least partially or even predominantly in the at least one second sub-region of the component, which has comparatively high strength and comparatively low ductility. It is possible for a bainitic microstructure to be produced at least partially or even predominantly in the at least one first sub-region of the component, which has comparatively low strength and comparatively high ductility.

LIST OF REFERENCE NUMERALS

1 component
2 first furnace
3 temperature control station
4 first sub-region
5 second sub-region
6 second furnace
7 press hardening tool
8 device
9 nozzle
10 fluid
11 heating station
12 temperature difference

The invention claimed is:

1. A method for heat treating a metal component, comprising at least the following steps:

a) heating the component in a first furnace;
b) moving the component into a temperature control station;
c) cooling at least one first sub-region of the component in the temperature control station, wherein a temperature difference is set between the at least one first sub-region and at least one second sub-region of the component;
d) moving the component from the temperature control station into a second furnace; and
e) heating at least the at least one first sub-region of the component in the second furnace by at least 200 K.

2. The method according to claim 1, further comprising at least the following steps:

f) moving the component from the second furnace into a press hardening tool; and
g) forming and cooling the component in the press hardening tool.

3. The method according to claim 1, wherein the component is heated in step a) to a temperature below the Ac3 temperature.

4. The method according to claim 1, wherein the component is heated in step a) to a temperature above the Ac3 temperature.

5. The method according to claim 1, wherein the at least one first sub-region is cooled in step c) by way of convection to a temperature below the Ac1 temperature.

6. A method for heat treating a metal component, comprising at least the following steps:

a) heating the component by way of radiant heat and/or convection by at least 500 K;
b) cooling at least one first sub-region of the component, wherein a temperature difference of at least 100 K is set between the at least one first sub-region and at least one second sub-region of the component (1); and
c) heating at least the at least one first sub-region of the component by way of radiant heat and/or convection by at least 100 K.

7. The method according to claim 6, wherein the component is simultaneously formed and cooled in step d).

8. The method of claim 1, further comprising using a furnace for heating at least sub-regions of the metal component, comprising the first and second sub-regions that have been controlled to differing temperatures, by way of radiant heat by at least 100 K.

* * * * *